United States Patent [19]

Kwan et al.

[11] 3,995,730

[45] Dec. 7, 1976

[54] DOT MATRIX IMPACT PRINTER HAVING RETRACTABLE PLATEN

[75] Inventors: Okun Kwan, Trumbull; Robert Jefferys, Darien, both of Conn.

[73] Assignee: Bunker Ramo Corporation, Oak Brook, Ill.

[22] Filed: Mar. 31, 1975

[21] Appl. No.: 563,390

[52] U.S. Cl. ..... 197/127 R; 197/133 R; 101/287

[51] Int. Cl.[2] ..... B41J 13/00

[58] Field of Search ..... 197/126 R, 126 A, 126 B, 197/127 R, 128, 133 R, 133 P, 134, 138 R, 1 R, 136, 139, 148; 226/93, 95, 147, 149, 150; 101/287, 288, 269

[56] References Cited

UNITED STATES PATENTS

| | | | |
|---|---|---|---|
| 3,616,889 | 11/1971 | Kley | 197/127 R |
| 3,776,341 | 12/1973 | Dobner et al. | 197/127 R |
| 3,815,722 | 6/1974 | Sessoms | 197/127 R |
| 3,837,461 | 9/1974 | Waibel | 197/126 A |
| 3,868,008 | 2/1975 | Brumbaugh | 197/127 R |
| 3,894,624 | 7/1975 | Long et al. | 197/127 R |

*Primary Examiner*—Ralph T. Rader
*Attorney, Agent, or Firm*—F. M. Arbuckle

[57] ABSTRACT

A dot matrix impact printer includes a retractable platen which positions an elongated sheet of paper in a location where a print head prints a line of data on the paper. In a second mode of operation, the insertion of a form, shorter than the elongated sheet of paper, is detected by photodetecting means. The form is inserted in overlying relation to the elongated sheet, where it is juxtaposed against the retractable platen. The photodetecting means in turn activate a solenoid. Activation of the solenoid displaces relatively small rollers against the inserted form in a manner pressing the form against the elongated sheet of paper. An intermediate length of the sheet is supported by a relatively large roller which undergoes indexed movement. As the sheet undergoes indexed movement during a printing operation, so does the form. At the end of a printing operation, the solenoid automatically retracts the relatively small rollers thereby permitting the withdrawal of the form.

10 Claims, 5 Drawing Figures

FORM POSITIONED HERE
120 PAPER
115
122
124
142
144
148
128
132
146
136
130
138
80
126
134
140
130
146
154
152
150
156
AMP

DOT MATRIX IMPACT PRINTER HAVING RETRACTABLE PLATEN

FIELD OF THE INVENTION

The present invention relates to dot matrix impact printers or the like, and more particularly to such a printer that has a retractable platen capable of accommodating an elongated sheet of paper as well as an insertable shorter form.

BRIEF DESCRIPTION OF THE PRIOR ART

Impact printing is performed by the familiar method of a type bar forced against an inked ribbon positioned between the type bar and paper to produce a character. Impact matrix printing is similar, except, each segment of the character is printed independently to produce the character. One example of a conventionally available printer of this sort is manufactured by the Victor Comptometer Corporation of Chicago, Illinois, and is denoted by Model IPM 130. This printer includes a dot matrix impact print mechanism with seven dots aligned at a 10° slant from the vertical to produce character sets. Any conceivable character format available in a seven vertical dot pattern is obtainable. This arrangement is useful for the popular 5 × 7 and 9 × 7 fonts. Characters are formed in a two dimensional array of dots. The dots are impact printed by wires driven by print solenoids in a print head. There are 416 dot columns available with the space of 1/130 inch between each, or a total print line width of 3.2 inches. Each individual solenoid can print every other dot column for a minimum distance between dots made by an individual solenoid of 0.01538 inches. The referenced Victor printer utilizes an elongated sheet of paper, hereinafter referred to as a continuous roll of paper, for printing. A cylindrical platen has a stationary axis of rotation which confronts the print head. The platen is fixedly positioned at a preselected distance from a printing plane which is a plane defined by the points where the print head wires impact a ribbon against the paper.

Although this mechanism works quite satisfactorily for the intended roll paper, the small gap between the platen and the printing plane is constant and does not permit the insertion of an additional form, such as a punch card or carbon set form, shorter than the continuous paper roll, and hereinafter referred to as a non-continuous form. Since Oftentimes, it is desirable to handle a paper roll which is wound up as it is used, to preserve information thereon, as well as a non-continuous form. Thus, it would be of great advantage to provide a dot matrix impact printer with a mechanism that is capable of varying the gap between the printing plane and a paper supporting platen, the mechanism further having a take-up reel for the paper expended from a roll.

BRIEF DESCRIPTION OF THE PRESENT INVENTION

The present invention is an improvement of the prior art dot matrix impact printers such as typified by the referenced commercial unit. In lieu of a constant gap between a cylindrical platen and the printing plane where printing impact is made, the present invention utilizes a retractable platen that is capable of compensating for the additional thickness created by the insertion of a non-continuous form between the print plane and the retractable platen. Photo detecting means are used to sense the introduction of a non-continuous form so that a solenoid actuated roller may be brought to bear against the non-continuous form thereby causing it to index or move with the paper form the paper roll in the printer. As a result, a printing will occur on the form, rather than the paper from the roll, when and only when a positive detection of such a form is made. At other times, the mentioned rollers remain disengaged from the printer mechanism so that the paper from the paper roll is moved through the printer mechanism in an ordinary manner. The paper from the paper roll is wound up on a take-up reel to preserve the information printed thereon.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
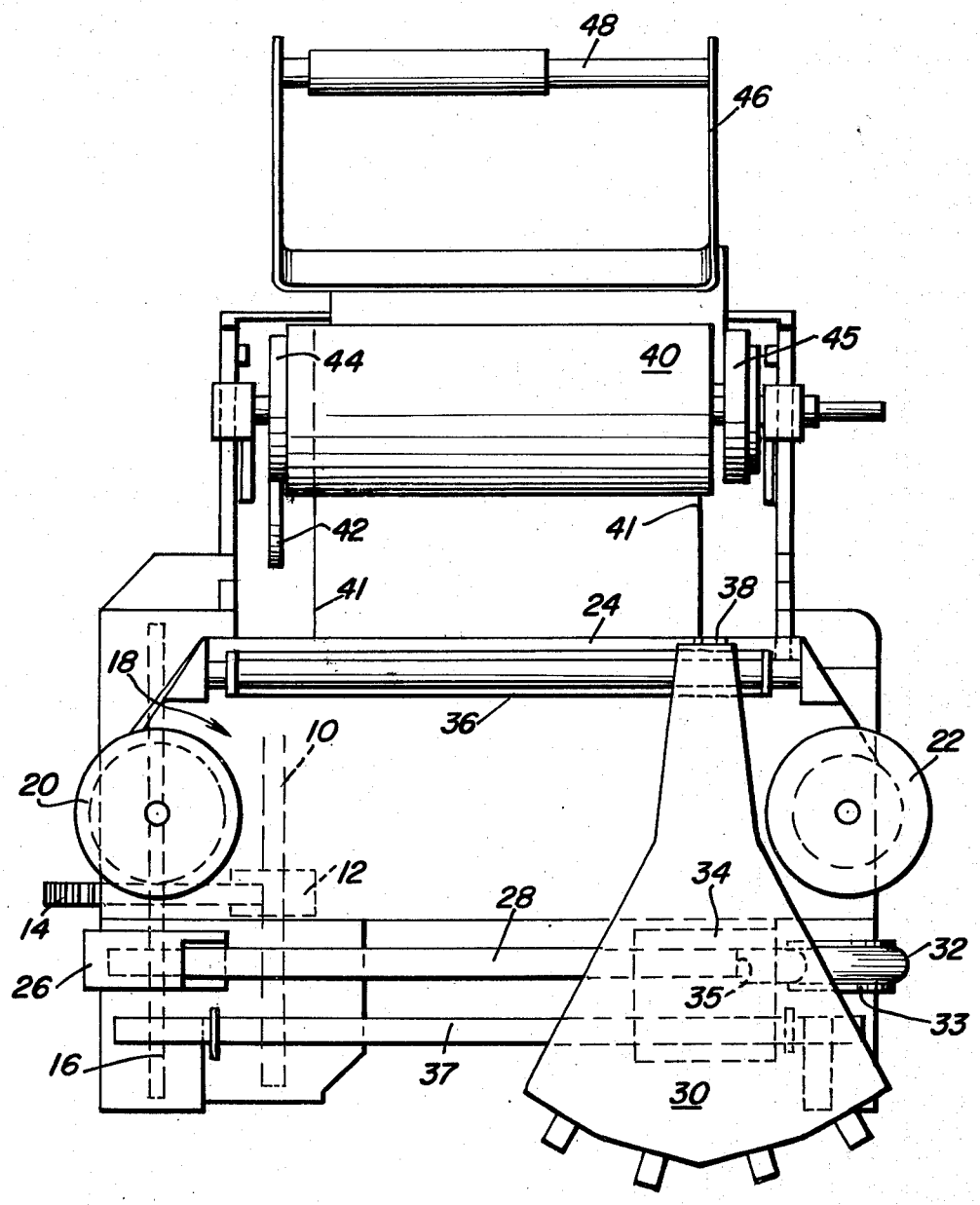
FIG. 1 is a top plan view of the basic elements in a dot matrix impact printer, as utilized by the present invention.

Referring to the figures, and more particularly FIG. 1 thereof, a simplified top plan view of the present printer is illustrated. This figure is simplified in that many components are not illustrated for purposes of initial clarity. The figures to be described hereinafter include further detail of the invention.

A main drive shaft 10 extends forwardly from a drive motor (not shown). A gear 12 mounted on the shaft 10 mates with a second gear 14 that is keyed with a second shaft 16, parallel to the output shaft 10. The gears 12–14 step down the speed of shaft 16, compared with shaft 10. A ribbon deck, generally indicated by 18 is positioned over the shafts and gears discussed. The deck accommodates ribbon spools 20 and 22 from which a length of ribbon 24 is created to be contacted by print head 30. The deck, carrying ribbon spools 20 and 22, is altlernately shifted between two positions, by a cam (not shown), mounted on shaft 16. As the deck alternates between these two positions, the upper and lower halves of the ribbon 24 are fully utilized.

A spool 26 is mounted on the shaft 16 and undergoes rotational motion to wind up a rubber belt 28 which has its left and fixed to the spool 26. The opposite end of belt 28 is fixed to a journal block 34, at indicated point 35. The journal block supports the enlarged end of print head 30. Thus, as belt 28 is wound on spool 26, the journal block 34 is urged to the left, which in turn causes the print head 30 to undergo a scanning motion across the length of ribbon 24. When the print head 30 reaches the leftmost position of scanning displacement, the sppool 26 becomes free to unwind. A pulley wheel 33 is appropriately mounted on a shaft (not shown) while entraining a spring 32, which is connected at its leftmost end to point 35, while an opposite end is stationarily positioned. Thus, a spool 26 becomes free to unwind, at the leftmost position of a print head scan, the spring resiliently forces the journal block 34 and its supported print head 30 to the rightmost or initial scanning position. A smooth shaft 37 is journalled through block 34 and provides means for guiding the scanning motion of the print head 30, at the enlarged end thereof. A similar shaft 36 is provided at the opposite end of the print head, the shaft 36 being journalled through the narrow end of the print head, as illustrated. The end of the dot matrix impact wires are illustrated at 38 and in operation of the device, the impact wires impact against ribbon 24 to imprint character images on a roll of paper which passes through a printing plane located in close proximity to the ribbon length 24, opposite the ribbon side against which impact is made.

A roller 40 is positioned rearwardly of the ribbon 24 and is used to guide an unwound section from a continuous paper roll as will be shown and explained in greater detail, hereinafter. Lines 41 represent the extremes of a scan during which the print head 30 prints.

A driving gear 42 engages gear 44 that is mounted to the left end of the roller 40. Thus, as gear 42 rotates so will roller 40. A ratchet gear 45 is disposed at an opposite end of roller 40. A pawl (not shown) cooperates with the ratchet gear 45 to increment the rotational motion of roller 40, in discrete amounts.

A frame 46 is provided, rearwardly of roller 40, for mounting a roll of paper. A mandrel 48 is removably positioned between opposing legs of frame 46. The mandrel 48 mounts the supply roll of a continuous paper roll.

Figure 2:
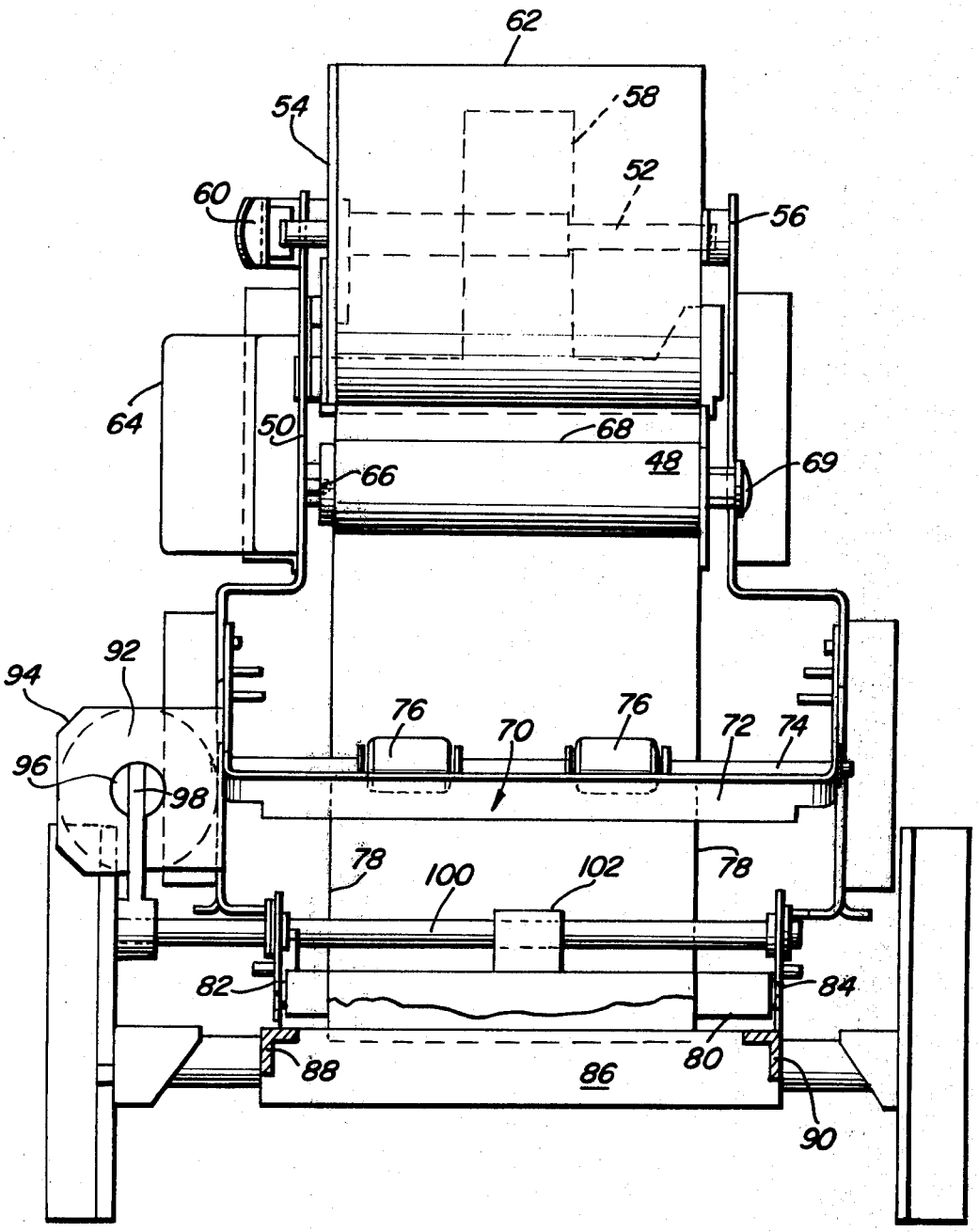
FIG. 2 is a top plan view of a mechanical assembly module which is fitted together with the structure of FIG. 1 to create the present invention.

Referring to FIG. 2, additional structure of the printer in accordance with the present invention, is illustrated. This structure is essence comprises a second module which is fitted together with the structure shown in FIG. 1, which represents a first module. The complete structure is, in accordance with further aspects of the invention, substantially illustrated in FIGS. 3 and 4. However, for purposes of clarity, the individual mechanical structure of FIG. 2 will be now discussed.

A supply mandrel 52 is disposed between side brackets 54 and 56. The mandrel is removable when a spring clip 60 is pressed laterally outwardly to permit removal of the mandrel 52 and insertion of a continuous paper roll 62. A sheet metal flange 58 is disposed beneath the roll 62 and provides initial paper guiding forwardly to the printing components. In accordance with the present invention, a mounting bracket 50, connected to frame 46 (FIG. 1), is seen to mount a motor housing 64 which has an output shaft 66 connected to the take-up reel 48. In further accordance with the present invention, the motor is apply a gentle winding or take-up torque to the reel 48 so that the paper roll may be kept taut. The motor is typically an AC synchronous motor, such as the type available from the General Time Corporation and known by model number H-4, and would normally have a synchronous speed of 60 rpm. However, in accordance with the invention, since the motor is really used as a torquing device, the voltage of the motor is stepped down from 117 volts to 80 volts. As a result, at this lowered operating voltage, the motor will not overheat and does apply a gentle torque to the wind-up reel, sufficient to maintain a taut paper roll. The paper which is wound up on the take-up reel 48 is indicated by 68. The mandrel 48, mounting the wound-up paper may be simply removed when the supply roll of paper is exhausted. This is simply done by pressing the clip 69 laterally outwardly thereby permitting rapid removal of the mandrel 48.

A spring loaded pivotally mounted bar is generally indicated by reference numeral 70 and includes an elongated member 72 that mounts a shaft 74 across the opposite ends thereof. Two spaced rollers 76 are mounted on the shaft 74 and when the elongated member 72 is lowered, the rollers 76 engage an intermediate point along the paper roll. As will be seen more clearly in FIG. 3, the rollers 76 and the larger roller 40 mate with one another to drive the passage of paper therebetween, as clearly shown in FIG. 4. Reference numeral 78 defines the lateral edges of the paper coming from the supply roll 62. An elongted roller 80 is positioned between parallel spaced support brackets 82 and 84. The roller engages the lower surface of the paper roll as will be seen in FIG. 4. A bracket 86 is positioned in front of the roller 80 and serves to support paper thereagainst as a platen, to be discussed hereinafter, urges the paper against bracket 86 during a printing operation. Abutments 88 and 90, formed in the bracket 86 bound an opening in bracket 86, through which print head wires impact ribbon length 24 against paper positioned in a printing plane.

A solenoid 92 is supported by a laterally extending bracket 94. The solenoid has a plunger 96 which reciprocates during a printing operation thereby causing a bell crank 98 to undergo two extreme displacements. This causes a rotational motion of a shaft 100 in a first direction then a second. The shaft 100 is positioned between the brackets 82 and 84. Intermediate along the length of the shaft 100 is a cam 102 which serves to move a movable platen between a withdrawn and an engaging position as will now be discussed with reference to FIGS. 3 and 4.

Figure 3:
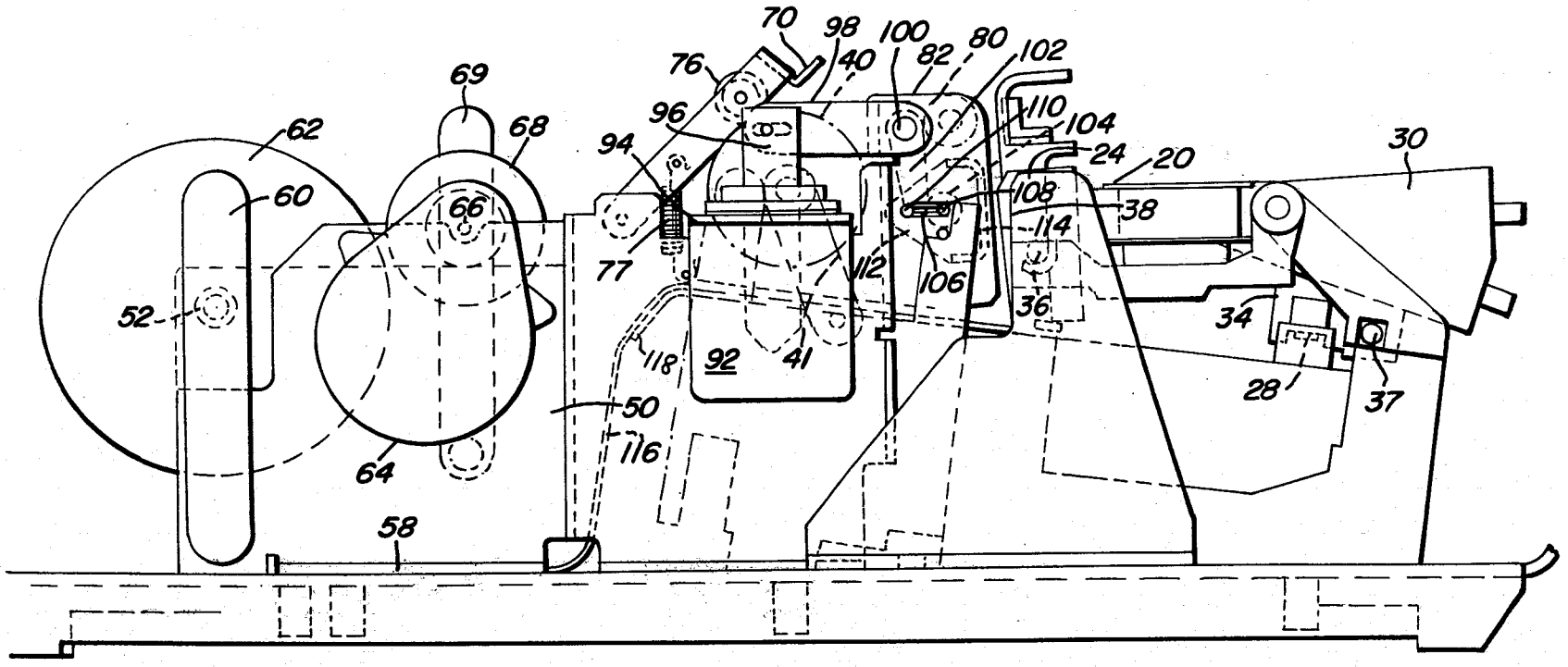
FIG. 3 is a side cross sectional view of the resulting invention particularly illustrating a movable platen in a retracted position.

The movable platen is shown in FIG. 3 and denoted by reference numeral 114. The platen has transverse brackets 112 having pins 108 and 110 extending laterally outwardly thereform. Elongated slots 106 are formed in the brackets 82 and 84 (FIG. 2) to permit passage of the pins 106 and 110, therethrough. A roller 104 is mounted along an intermediate point of the platen 114 and is particularly adapted as a cam follower, for cam 102. Although not illustrated, springs are connected between the pin 108 and a fixed point on the printer to normally urge the platen 114 into a withdrawal position, as illustrated in FIG. 3. However, when the solenoid 92 (FIG. 2) is activated by a print command electrical signal, typically generated by depression of a keyboard (not shown), the shaft 100 undergoes rotation to force the cam 102 into engagement with the roller 104 and urge the roller 104 to the right as viewed in FIG. 3 thereby urging the platen 114 into engagement with a section of paper located in the printing plane. The thickness of paper positioned between the platen 114 and the bracket 86 may be variable because the plunger 96 of solenoid 92 will extend until resistance is met, corresponding to engagement of paper against bracket 86, by platen 114. In order to ensure that the unrolling paper from the continuous paper roll does not develop sufficient slack length to move into parts of the printer where jamming would occur, guide plates 116 are provided under the take-up reel 68, additional paper guide means 118 being providing to guide the paper below roller 40.

Figure 4:
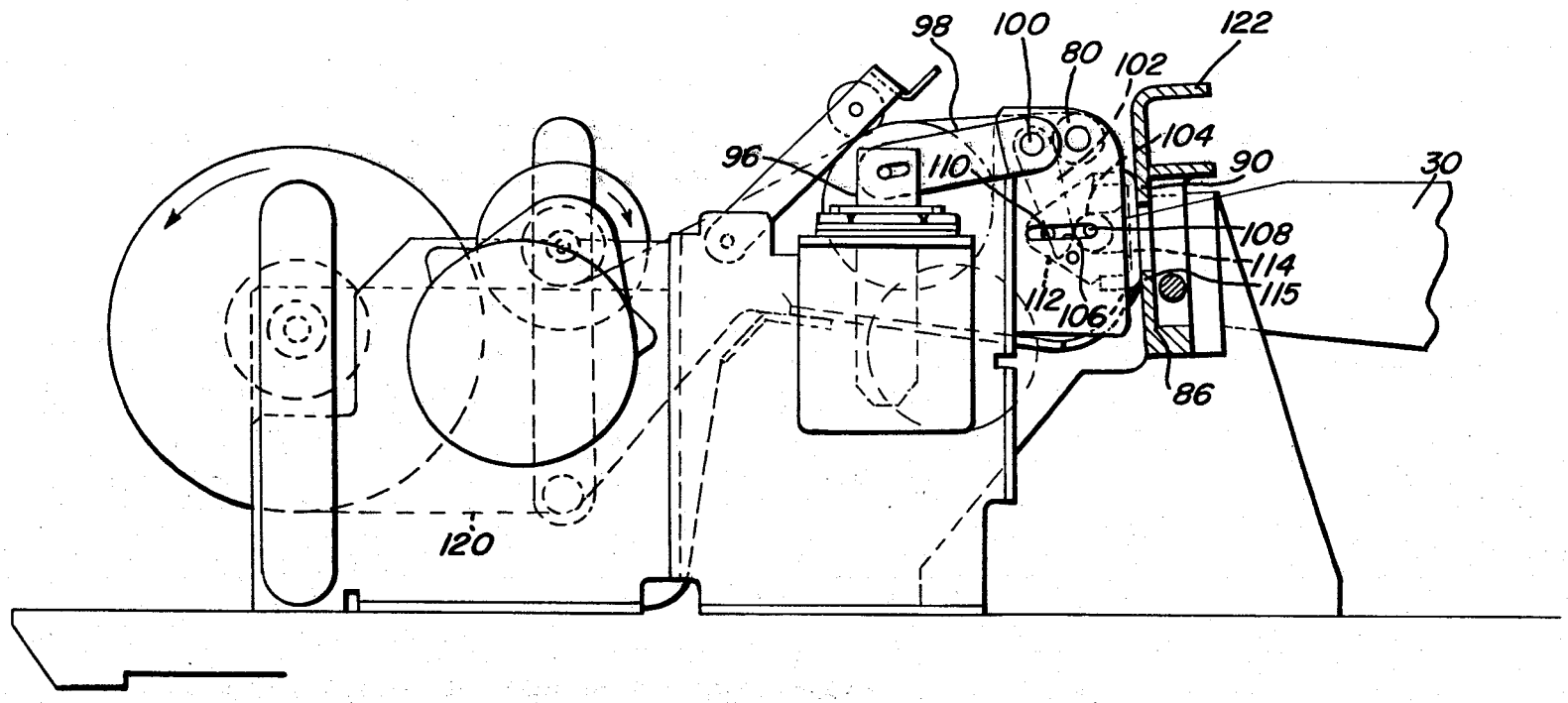
FIG. 4 is a side cross sectional view of the resulting invention particularly showing the movable platen in an engaged position.

Viewing FIG. 4, the path of paper travel is clearly indicated by reference numeral 120. In this figure, the platen is shown in an engaged position whereby it forces an unwound section from the paper roll against the abutment areas 90 and 115 of bracket 86 whereby the paper will be in a printing plane where the printing head 30 impacts the ribbon against the paper. It is most important to note that the withdrawal of platen 114 in FIG. 3 creates a gap between the platen and the abutment areas 90 and 115 (FIG. 4) of sufficient dimension to permit the insertion of a non-continuous form, such as a punch card or multiple section form, therein. In the event of such insertion, the printing will occur on the non-continuous form since it is the form that is brought into the printing plane when the platen 114 is moved into the engaged position of FIG. 4. Normaly when printing is not desired on a non-continuous form, but rather on the continuous roll paper, the movable platen accommodates this requirement by merely moving the roll paper into the printing plane. Thus, the retractable platen permits utilization of the dot matrix impact printer for a normally used roll paper as well as for non-continuous forms that are selectively inserted into the printer by a machine operator. Such examples of non-continuous forms are validation receipts, given by banks and multiple carbon sets.

Figure 5:
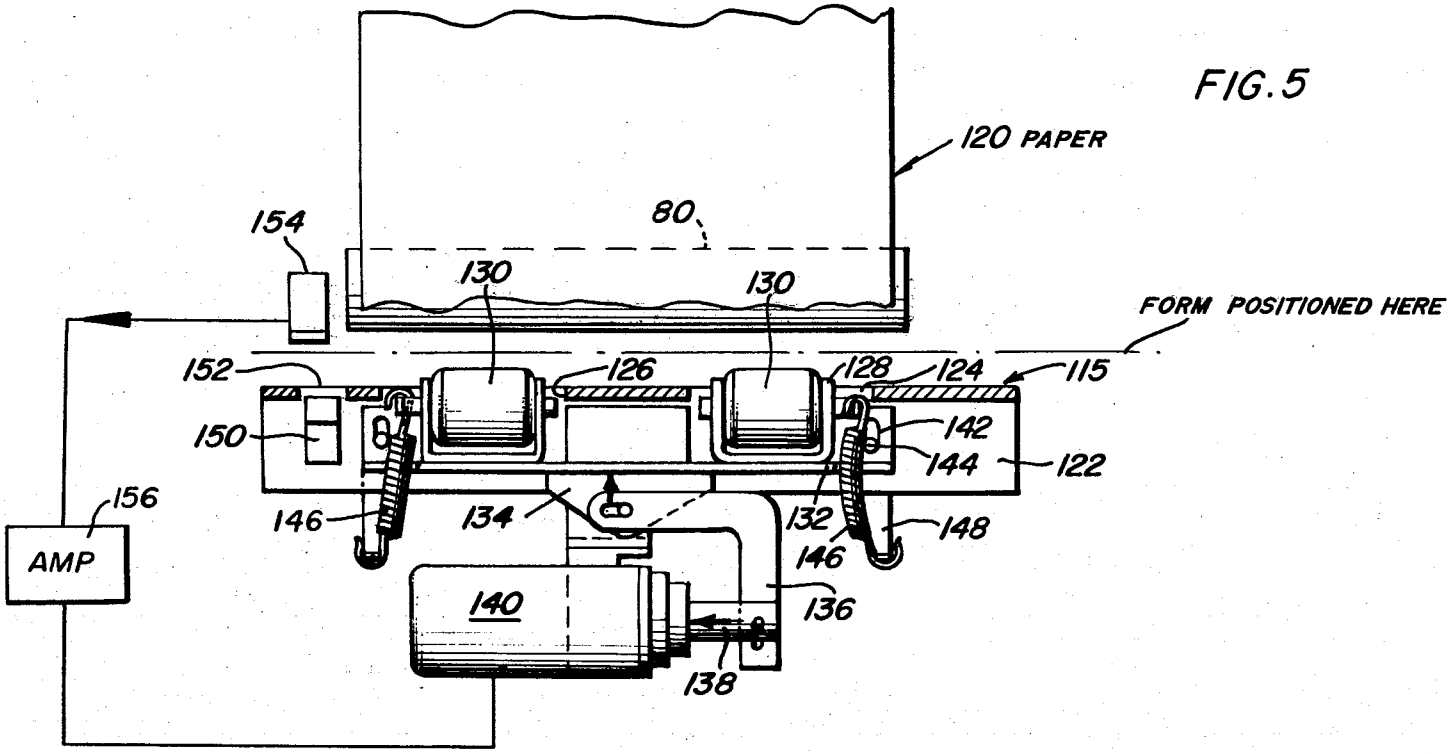
FIG. 5 is a top plan cut-away view of a mechanical assembly for indexing the movement of an inserted form.

FIG. 5 illustrates additional structure for ensuring that an inserted form is indexed or moved properly after a complete line has been imprinted thereon.

The roll paper is shown, in FIG. 5, by reference numeral 120. The paper is brought up over the top of roller 80, as shown in FIG. 4. When a non-continuous form is not inserted into the printer, the roller 80 merely supports a length of paper 120. However, upon insertion of a form between the paper 120 and the bracket 86, auxiliary rollers 130 are moved, through opening 124 and 126, into engagement with the inserted form, which is then pressed against the roll paper 120. Once this occurs, the form will be indexed or will travel with the roll paper during a multiple line printing operation. Referring to FIG. 5, in accordance with the invention, sensing means such as a miniature radiant light source 150 has its light interrupted and a detection signal is generated by the photo detector 154. The source 150 is positioned on the bracket 122 that is located above bracket 86 (FIG. 4). An opening 152 is formed in the flange 115 of bracket 86 to permit passage of light from the source 150 to the detector 154. The detector is suitably mounted to a stationary bracket (not shown) so that alignment between the source and the detector 154 may be ensured. Other sensing means may be employed. The generation of a detection signal is utilized by a solenoid in a conventional manner such as commonly used in photoelectric door openers. For example, an amplifier 156 connecting the detector 154 to solenoid 140 carries a detection signal to depress plunger 138 inwardly thereby moving the L-shaped bell crank 136 in a generally clockwise direction, as viewed in FIG. 5. Slotted connection at both ends of the bell rank 136 cause a bracket 134 to move upwardly or inwardly toward paper 120, as viewed in FIG. 5. The bracket 134 therefore moves relative to the stationary bracket 122. Attached to the bracket 134 is a cross piece 132 and brackets 128, to which the rollers 130 are mounted. The cross piece 132 has slots 142 formed therein which slide relative to pins 144, the latter being fixed to bracket 122. Thus, the motion of cross piece 132 and rollers 130 is guided in a straight direction, toward the roller 80. Coil springs 146 are connected between a mount 148, stationary with bracket 122, and a tab on an associated roller 130. The springs 146 normally bias the rollers 130 into a withdrawn position which permits the easy entry of a form. However, upon detection of the insertion of a form by the photo sensing means 150, 154, the solenoid 140 drives the rollers 130 into engagement with the inserted form, against the paper 120 and the back supporting roller 80. The engagement between rollers 130, roller 80 and paper therebetween is variable because plunger 138 of solenoid 140 is displaced outwardly until sufficient resistance is met, indicative of engagement between the rollers 130, roller 80 and paper therebetween.

The operational steps that occur during the printing of an inserted form are as follows:

1. Insertion of a non-continuous form.
2. Indentification of insertion by photosensing means 150, 154 in FIG. 5.
3. Keyboard manual button (not shown) depression to generate a print command electrical signal for causing energization of printing components and solenoid.
4. Energization of solenoid 140 to engage rollers 130 and roller 80 (FIG. 5) against the form and a section of paper from the roll thus driving the form with indexed movement.
5. Energization of solenoid 92 to move the platen 114 (FIG. 4) into engagement with paper 120, the form supported by bracket 86 being juxtaposed with the paper 120.
6. Operation of the print head 30 in response to a print command electrical signal, along a printing plane where the form is to be printed (FIG. 4).
7. Return of print head to original position.
8. De-energization of solenoid 92 after occurrence of a print command electrical signal thus retracting platen 114.

It should be understood that the invention is not limited to the exact details of construction shown and described herein for obvious modifications will occur to persons skilled in the art.

What is claimed is:

1. A retractable platen mechanism comprising:

a platen member moveable form a disengaged to an engaged position;

paper supporting means positioned opposite the platen member for engaging continuous paper or an insertable non-continuous form between the supporting means and the platen member when the member is in an engaged position;

an opening in the supporting means for admitting printing means therethrough for printing on continuous paper or an insertable non-continuous form when the platen member is in he engaged position;

cam following means mounted to the platen member for movement therewith;

first electromagnetic means having a member moveable between first and second positions;

linkage means connected between the moveable member and camming means which drives the cam following means, energization of the electromagnetic means causing the camming means to force displacement of the cam following means by an amount accomplishing movement of the platen member to an engaged position;

paper supply and take-up means for moounting continuous paper thereon;

means located between the supply and take-up means for guiding continuous paper between the supporting means and the platen member;

first roller means located near the platen member for supporting a moveable length of continuous paper thereon;

means located adjacent the platen member for detecting the insertion of a non-continuous form adjacent a platen member;

second electromagnetic means actuable in response to the detection of an inserted form; and second roller means linked to the second electromagnetic means for depressing the form against the continuous paper and first roller means, thus accomplishing joint indexed motion therebetween.

2. The subject matter of claim 1 wherein the first electromagnetic means is a solenoid that is energizable during a printing operation.

3. The subject matter of claim 1 wherein the second electromagnetic means is a second solenoid, and further wherein the detecting means comprises a radiant light source shining a light beam near an adjacent photoelectric detector, the beam being interrupted when the form is inserted, causing the generation of a signal which actuates the second solenoid.

4. The subject matter set forth in claim 3 together with linkage means connected between a plunger of the second solenoid and the second roller means.

5. The subject matter set forth in claim 4 together with:

motor means connected to the paper take-up means for exerting sufficient torque thereon to ensure proper winding of printed paper on he take-up means.

6. A dual mode dot matrix impact printer comprising:

a print head;

a retractable platen member for supporting paper to be printed in a printing plane during a printing operation;

an ink ribbon positioned adjacent the head, in spaced parallel relation to the platen member;

means for moving the head across the ribbon during a print operation;

means connected to the platen member for moving it from a normally removed location to a location positioning the paper in the print plane;

supply and take-up reels for feeding a sheet of rolled paper across the platen member;

roller means located near the platen member for supporting a movable length of continuous paper thereon;

means located adjacent the platen member for detecting the insertion of a non-continuous form;

means responsive to the detection of a form for generating an electrical signal; and electromechanical means responsive to the electrical signal or movably engaging the form against the paper and the roller means for indexed movement therewith, during a printing operation by the head on the form.

7. The adjacent matter set forth in claim 6 together with means connected to the take-up reel for applying a torque to the reel thus moving printed paper onto the wind-up reel.

8. The subject matter set forth in claim 6 wherein the means for moving the platen member comprises:

a solenoid energizable in response to an electrical signal, indicative of a print command;

a shaft having a cam mounted along an intermediate point thereon;

linkage means connected between a plunger of the solenoid and the shaft; and cam following means mounted to the platen member for engagement by the cam, actuated motion of the linkage means causing the cam to force the cam following means and the platen member to a location that enables the print head to complete a print operation on the roll paper or an inserted form, when the latter is detected.

9. The subject matter set forth in claim 7 wherein the torque applying means comprises an AC synchronous motor having a stepped-down voltage applied to the input thereof.

10. The subject matter set forth in claim 8 wherein the electromechanical means comprises a second solenoid having a plunger connected to a first end of second linkage means, and further wherein a bracket, connected to the second end of the second linkage means, mounts second roller means thereto, the second roller means moving against the form in response to the electrical signal for achieving the indexed movement of a form.

* * * * *